US011432611B2

(12) United States Patent
Kim et al.

(10) Patent No.: US 11,432,611 B2
(45) Date of Patent: Sep. 6, 2022

(54) MANUFACTURING METHOD OF A THERMOPLASTIC ELASTOMER YARN

(71) Applicant: JEONGSAN INTERNATIONAL Co., Ltd., Busan (KR)

(72) Inventors: Gu Hwan Kim, Busan (KR); Yong In Cho, Busan (KR); Chan Won Lee, Changwon-si (KR)

(73) Assignee: JEONGSAN INTERNATIONAL Co., Ltd., Busan (KR)

( * ) Notice: Subject to any disclaimer, the term of this patent is extended or adjusted under 35 U.S.C. 154(b) by 56 days.

(21) Appl. No.: 16/711,809

(22) Filed: Dec. 12, 2019

(65) Prior Publication Data

US 2020/0214383 A1 Jul. 9, 2020

(30) Foreign Application Priority Data

Jan. 7, 2019 (KR) ..... 10-2019-0001892

(51) Int. Cl.

| | |
|---|---|
| ***D01D 5/088*** | (2006.01) |
| ***D01D 5/12*** | (2006.01) |
| ***D01D 5/16*** | (2006.01) |
| ***D01D 10/06*** | (2006.01) |
| ***D01F 6/86*** | (2006.01) |
| ***D01F 11/08*** | (2006.01) |
| ***D02J 1/02*** | (2006.01) |
| ***D06M 11/77*** | (2006.01) |
| ***D06M 13/02*** | (2006.01) |

(Continued)

(52) U.S. Cl.

CPC ..... *A43B 1/14* (2013.01); *D01D 5/0885* (2013.01); *D01D 10/02* (2013.01); *D01F 6/62* (2013.01);

(Continued)

(58) Field of Classification Search

CPC ..... D01D 5/088; D01D 5/0885; D01D 5/12; D01D 5/16; D01D 10/02; D01D 10/06;

(Continued)

(56) References Cited

U.S. PATENT DOCUMENTS

2006/0135699 A1 6/2006 Li et al.
2009/0131625 A1* 5/2009 Kurian ..... C08G 63/672 528/176

(Continued)

FOREIGN PATENT DOCUMENTS

CN 102851780 A 1/2013
CN 102851780 B * 3/2014 ..... D01D 5/088

(Continued)

OTHER PUBLICATIONS

Translation of CN 102851780 B (published on Mar. 26, 2014).*

(Continued)

*Primary Examiner* — Leo B Tentoni

(74) *Attorney, Agent, or Firm* — Stetina Brunda Garred and Brucker

(57) ABSTRACT

The present invention relates to a thermoplastic elastomer yarn with improved unwinding, weaving and yarn shrinking property, and a manufacturing method thereof. According to the present invention, the thermoplastic elastomer yarn according to the present invention is excellent in improved unwinding, weaving and yarn shrinking property.

Furthermore, the thermoplastic elastomer yarn according to the present invention is excellent in yarn shrinkage rate, unwinding, weaving, tensile strength and elongation rate to be adequate for manufacturing textile fabric and footwear in terms of physical properties.

4 Claims, 1 Drawing Sheet

(51) Int. Cl.

| | |
|---|---|
| ***A43B 1/14*** | (2006.01) |
| ***D01D 10/02*** | (2006.01) |
| ***D01F 6/62*** | (2006.01) |
| ***D02J 1/22*** | (2006.01) |

(52) U.S. Cl.
CPC ..... *D02J 1/223* (2013.01); *D02J 1/228* (2013.01); *D10B 2331/04* (2013.01); *D10B 2401/062* (2013.01)

(58) Field of Classification Search
CPC ..... D01F 6/86; D01F 11/08; D02J 1/02; D02J 1/223; D02J 1/228; D02J 13/00; D06M 11/37; D06M 13/02
USPC ..... 264/103, 178 R, 178 F, 210.7, 210.8, 264/211.14, 211.15, 211.17, 331.21
See application file for complete search history.

(56) References Cited

U.S. PATENT DOCUMENTS

2013/0273285 A1* 10/2013 Vedula ..... D01F 6/86 264/103 X
2015/0157514 A1* 6/2015 Cinquemani ..... D01D 5/088 604/369

FOREIGN PATENT DOCUMENTS

| | | | | |
|---|---|---|---|---|
| CN | 105074081 | A | * 11/2015 | ..... D06M 13/02 |
| CN | 108842307 | A | 11/2018 | |
| JP | S60209039 | A | 10/1985 | |
| JP | 401298239 | A | 12/1989 | |
| JP | 2004-068240 | | 3/2004 | |
| JP | 2011-157639 | | 8/2011 | |
| JP | 2012031551 | A | 2/2012 | |
| JP | 2018118504 | A | 8/2018 | |
| KR | 960010623 | | 4/1996 | |
| KR | 1020160094836 | A | 8/2016 | |

OTHER PUBLICATIONS

Translation of KR 100252701 B1 (published on Apr. 15, 2000).*
Translation of CN 105074081 A (published on Nov. 18, 2015).*
Office Action for Korean Application No. 10-2019-0001892, dated Feb. 6, 2020, 4 pages.
European Patent Office, European search report for Application No. 19214708.0-1107, dated Mar. 13, 2020, 8 pages.
Office Action for corresponding Japanese Application, dated Dec. 21, 2020, 3 pages.

* cited by examiner

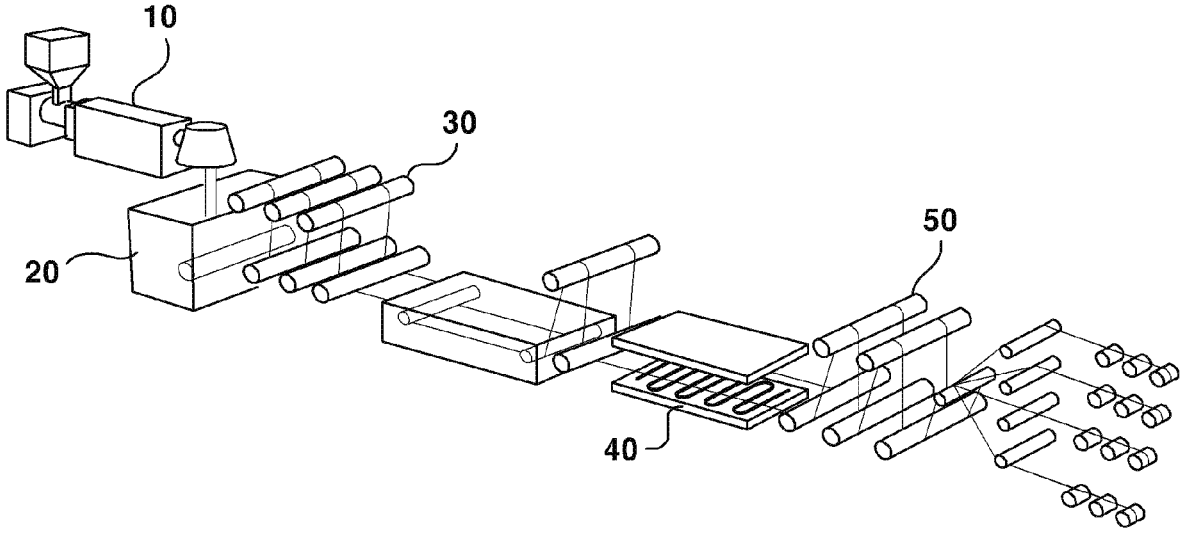
10
30
20
50
40

MANUFACTURING METHOD OF A THERMOPLASTIC ELASTOMER YARN

CROSS-REFERENCE TO RELATED APPLICATIONS

Pursuant to 35 U.S.C. § 119 (a), this application claims the benefit of earlier filing dates and rights of priority to Korean Patent Application No.: 10-2019-0001892 filed on Jan. 7, 2019, the contents of which are hereby incorporated by reference in their entirety.

STATEMENT RE: FEDERALLY SPONSORED RESEARCH/DEVELOPMENT

Not Applicable

TECHNICAL FIELD

The present invention relates to a thermoplastic elastomer yarn with improved unwinding, weaving and yarn shrinking property, and a manufacturing method thereof.

BACKGROUND OF INVENTION

The modern days are rapidly developed in industries, improved in the levels of daily life, and changed in life patterns to allow various leisure activities in terms of leisure, hobbies and exercises to flourish, whereby, concomitant with this trend, demands on products grafted with new materials having distinguished functions and designs are rapidly on the increase. These characteristics are particularly outstanding in cases of shoe uppers, and therefore, products having pleasant wearability, air permeability, lightness, high intensity, flexibility and distinguishable functions, and products added with fashionability in design are rapidly on the increase.

As a material adequate for manufacturing conventional shoes, a process of manufacturing a mono filament yarn of thermoplastic copolymer material has been developed. The mono filament may be embodied in semitransparency, the copolymer is excellent in physical properties including elasticity, flexibility and abrasion strength, has a soft feeling, and therefore, can be made to be light in weight, such that the mono filament may be a material adequate for manufacturing shoes. Particularly, the recent manufacturing trend is to use a 'no sew' method configured to save labor cost, the method of which is an adhesive method using a hot-melt. As a result, materials are subject to heat and pressure in the course of manufacturing process, whereby the materials incur shrinkage to generate deformation in product sizes, resulting in difficulties in product manufacturing. Because of this disadvantage, necessity for controlled shrinkage of materials has surfaced, and development is required for thermoplastic elastomer yarn capable of satisfying both improved unwinding and weaving.

As a prior art, although the Korean Published Patent No.:1996-0010623 has been disclosed for manufacturing method of flexible fabric and knitted goods, the said Patent failed to disclose a manufacturing method of thermoplastic elastomer yarn satisfying all the requirements of improved unwinding, weaving and yarn shrinking property.

DETAILED DESCRIPTION OF INVENTION

Technical Subject

Therefore, it is an object of the present invention to provide a thermoplastic elastomer yarn configured to satisfy all the requirements of improved unwinding, weaving and yarn shrinking property, and a manufacturing method thereof.

Technical Solution

In one general aspect of the present invention, there is provided a manufacturing method of a thermoplastic elastomer yarn with improved unwinding, weaving and yarn shrinking property, the method comprising:

spinning a mono filament yarn of a thermoplastic elastomer material (S10);

drawing (elongating) the spun mono filament yarn after cooling (S20);

hot-air drying the drawn yarn under a heat-processing temperature of 170° C.~190° C. (S30); and processing the hot air-dried yarn with oil (oil-treating the air-dried yarn) (S40).

In some exemplary embodiments, the thermoplastic elastomer may be TPE copolymer or polyester-ether copolymer.

In some exemplary embodiments, the oil may be a mineral oil or a silicon oil.

In some exemplary embodiments, the oil may contain OPU (Oil Pick Up) at 0.2%~3%.

In some exemplary embodiments, the step of S10 may include an intrinsic viscosity of thermoplastic elastomer at 1.0~4.0.

In some exemplary embodiments, the step of S20 may comprise:

cooling the spun yarn under water with a temperature of 10° C.~50° C.;

implementing an initial elongation of the cooled yarn under water with a temperature of 70° C.~100° C.; and implementing a secondary elongation after the initial elongation using a hot air with a temperature of 120° C.~200° C.

In some exemplary embodiments, a thermoplastic elastomer yarn with improved unwinding, weaving and yarn shrinking property may be manufactured by the manufacturing method.

In another general aspect of the present invention, textile fabric may be woven with the thermoplastic elastomer yarn manufactured by the manufacturing method, wherein the textile fabric may be a cloth interwoven with weft and warp at a right angle, and there may be a plain fabric, a twill and a satin weave depending on a method of a cloth strong in tissues having many intersection points being manufactured and woven.

In still another general aspect of the present invention, shoes may be manufactured with the thermoplastic elastomer yarn manufactured by the manufacturing method according to an exemplary embodiment of the present invention.

Advantageous Effects

The thermoplastic elastomer yarn according to an exemplary embodiment of the present invention may have an improved unwinding, weaving and yarn shrinking property.

Furthermore, the thermoplastic elastomer yarn according to an exemplary embodiment of the present invention may have physical properties adequate for shoe manufacturing because of excellence in yarn shrinkage property, unwinding, weaving, tensile strength and elongation rate.

BRIEF DESCRIPTION OF DRAWINGS

FIG. 1 is a mimetic view explaining a weaving process for manufacturing a thermoplastic elastomer yarn according to an exemplary embodiment of the present invention.

BEST MODE

Now, exemplary embodiments of the present invention will be described in detail with reference to the accompanying drawings, and throughout the descriptions, the same reference numerals will be assigned to the same elements in the explanations of the figures, and explanations that duplicate one another will be omitted.

As used herein, suffixes such as "module", "part" and "unit" are added or interchangeably used to facilitate preparation of this specification and are not intended to suggest unique meanings or functions. It will be appreciated that the suffixes are not limited to such terms and these terms are merely used to distinguish one element from another and do not have mutually distinguishable meanings or functions per se.

In describing embodiments disclosed in this specification, a detailed description of relevant well-known technologies may not be given in order not to obscure the subject matter of the present invention. In addition, the accompanying drawings are merely intended to facilitate understanding of the embodiments disclosed in this specification and not to restrict the technical spirit of the present invention. In addition, the accompanying drawings should be understood as covering all equivalents or substitutions within the scope of the present invention.

It will be understood that, although the terms "first", "second", etc. may be used herein to describe various elements, these elements should not be limited by these terms. These terms are only used to distinguish one element from another element.

It will be understood that, when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

As used in the specification and in the claims, the singular form of "a", "an", and "the" include plural referents unless the context clearly dictates otherwise.

In this specification, terms such as "includes" or "has" are intended to indicate existence of characteristics, figures, steps, operations, constituents, components, or combinations thereof disclosed in the specification. The terms "includes" or "has" should be understood as not precluding possibility of existence or addition of one or more other characteristics, figures, steps, operations, constituents, components, or combinations thereof.

EXEMPLARY EMBODIMENTS

A manufacturing method for thermoplastic elastomer yarn according to an exemplary embodiment of the present invention may comprise: spinning a mono filament yarn of a thermoplastic elastomer material; drawing the spun mono filament yarn after cooling; hot-air drying the drawn yarn under a heat-processing temperature of 170° C.~190° C.; and processing the hot air-dried yarn with oil. A detailed process of each step is explained as under:

1. Raw Material Spinning

The raw material spinning relates to a process of spinning a mono filament yarn using a TPE copolymer. It is preferable that the moisture content of polymer raw material of yarn be less than 0.08%. The raw material may be dried before being inputted into an extruder (10). A drying condition may be for 4~12 hours under a temperature of 80° C.~150° C., and the raw material may be dried through a hot air drier or dehumidifying drier.

The raw material is inputted into an extruder (10), and cut with a desired thickness under a radiation temperature of 170° C.~260° C. At this time, in order to pull out a uniform thread, it is preferable that an intrinsic viscosity (IV) of the spun raw material be 1.0~4.0 (Unit: dl/g). When the intrinsic viscosity is lower than a lower limit, a spun flow grows higher to deteriorate the spun formation, and when the intrinsic viscosity is higher than an upper limit, the formation grows deteriorated to make it harder to pull out a uniform thickness of thread.

2. Cooling & Initial, Secondary Elongation

The spun yarn may be cooled in water in a cooling tank (20) with a temperature of 10° C.~50° C., and then, may be implemented in water with an initial elongation using an elongation roller (30) with a temperature of 70° C.~100° C. After the initial elongation, a secondary elongation is implemented by an elongation roller (50) using a hot air from a hot air blower (40) under a temperature of 120° C.~200° C., where a final elongation rate after the initial and secondary elongation may be 2~8 times.

3. Yarn Heat Treatment Process

The elongated yarn may be hot-air dried with a temperature of 170° C.~190° C. and relax-processed. Under this process, the roll speed may be more reduced by about 5~20% than that of the previous elongation process to relax the yarn for stabilization. A shoe manufacturing requires a shrinkage rate less than 1%, and in order to satisfy the said requirement, the shrinkage rate of yarn must be between 5%~10%. When the yarn heat treatment process is finished, the conventional yarn shrinkage rate of 30% may be adjusted to 5%~10%.

4. Oil Treatment

An oil treatment may be implemented on the yarn for improved weaving and equalization of tension during warping process. The oil treatment is performed to allow OPU (Oil Pick Up) to be at 0.2%~3.0 weight % (based on emulsion solid content) using an oiling treatment machine. The oil solid content may be such that oil in the form of emulsion shape is spread on the yarn using a roller and is dried, where the oil solid content is an amount of oil solid covered on the yarn after drying.

The used spin finish (oil) may be silicon oil or mineral oil (Liquid paraffin oil) in order to satisfy the unwinding and weaving. The fatty acid ester, fatty acid polyol ester, POE alkyl alkylate, polyether and wax (paraffin) among the generally used oils may be inadequate, because of failure to satisfy the unwinding and weaving.

In addition, an additive such as antistatic agent, anti-color agent or antioxidant may be simultaneously used in order to provide additional functions.

At this time, the yarn with oil treatment must be free from operability during warping and weaving, and therefore, the oils used in the scouring process must be removed before dyeing. The un-removed oils may be causes for imbalance of dyeing and degradation of adhesiveness. Oils may be removed by using 0.1%~5% of surfactant in a warm water of alkali condition under a temperature of 70° C.~100° C. before dyeing.

The said yarn has lots of flexibility and tackiness on the surface, such that, when the abovementioned components and throughput are not properly handled or removed, an operation is progressed while passing through various rolls during warping and weaving, where materials of used rolls are mostly made of metals to thereby increase friction with the metals, resulting unevenness, and particularly, thread cutting due to excessive tension during warping, yarn burrowing, warp lines due to uneven tension deviation in the yarn cones during weaving, creased yarn and the like are generated, and yarn particle stain is generated by an excessive surface friction during weft operations, and line deflect and creases may be generated.

Even if the above proposed components are correct when oils are treated, and when oil throughput is excessively implemented (more than OPU 3%), an excessive slip may be generated to cause stains on the guide rolls due to oil concentration during warping, warp lines and creases are generated during weaving due to uneven warp tension caused by excessive slips, and weft lines and creases are generated because uniform tension cannot be maintained due to failure in keeping the rubber stopper for maintaining the loose yarn on the warp beam at a predetermined tension during weaving.

Furthermore, when the components and throughput of yarn are not corresponded, the unwinding becomes deteriorated due to tackiness in the yarns when wound yarns are unwound, resulting in generation of excessive tension and imbalance during warping and weaving.

Even if the yarn satisfies the proposed elongation and heat treatment conditions, and if the oil treatment conditions are not met, quality on the product surfaces are directly affected by tension imbalance, warp line defect and stains due to yarn particles.

Comparison of Yarn Properties Based on Heat Treatment Temperature

In consideration of the fact that the shrinkage rate of yarn is affected by the heat treatment temperature in the above yarn heat treatment process, the heat treatment temperature for optimal heat treatment setting is set at 170° C. (first exemplary embodiment) and at 190° C. (second exemplary embodiment) and then, yarn shrinkage rate, unwinding, weaving and tensile strength and elongation rate were measured.

For comparison, yarn shrinkage rate, unwinding, weaving and tensile strength and elongation rate were respectively measured for a case of no heat treatment process (first comparative example), a case of heat treatment process at 100° C. (second comparative example), at 150° C. (third comparative example) and at 200° C. (fourth comparative example).

A property-measured result is shown in Table 1. Based on Table 1, the first and second exemplary embodiments according to the present invention are shown to be highly excellent over the first to fourth comparative examples in terms of yarn shrinkage rate, unwinding, weaving and tensile strength and elongation rate, and have physical properties adequate for shoe manufacturing.

TABLE 1

| Heat treatment temperature | Yarn shrinkage rate | unwinding | weaving | Shrinkage rate during shoe making | Tensile strength (150De) | Elongation rate |
|---|---|---|---|---|---|---|
| Heat treatment X(first comparative example) | 30% | X | X | More than 10% | 150~220 gf | 120~160% |
| 100° C.(second comparative example) | | X | X | | | |
| 150° C.(third comparative example) | 20% | X | X | More than 5% | 200~250 gf | 130~170% |
| 170° C.(first exemplary embodiment) | 10% | ○ | ○ | Less than 0.5~1% | 350~500 gf | 70~110% |
| 190° C.(second exemplary embodiment) | 5% | ○ | ○ | | 400~500 gf | 70~100% |
| 200° C.(fourth exemplary embodiment) | Physical property defects on yarn due to degradation | | | | | |

○: Excellent
Δ: average
X: bad

Comparison of Physical Properties Based on Kinds of Spin Finishes

The Table 2 shows a measured result of physical properties on yarn based on types of oils (spin finishes). It was confirmed that the oils satisfying the unwinding and weaving at heat treatment temperatures at 170° C. and 190° C. are respectively silicon oils and mineral oils (Liquid paraffin oils).

The fatty acid ester, fatty acid polyol ester, POE alkyl alkylate, polyether, wax (paraffin) among the spin finishes were determined as being inadequate as spin finish due to failure to satisfy the unwinding and weaving.

TABLE 2

| Oil types | OPU % | Heat treatment temperature | unwinding | weaving |
|---|---|---|---|---|
| No oil treatment | 0 | 170° C. | X | X |
| | | 190° C. | X | X |
| Liquid Paraffin oil | 1 | 150° C. | X | X |
| | | 170~190° C. | ○ | ○ |

TABLE 2-continued

| Oil types | OPU % | Heat treatment temperature | unwinding | weaving |
|---|---|---|---|---|
| Silicon oil | 1 | 150° C. | X | X |
| | | 170~190° C. | ○ | ○ |
| mineral + silicon oil | 1 | 150° C. | X | X |
| | | 170~190° C. | ○ | ○ |
| WAX(Paraffin) | 1 | 150° C. | X | X |
| | | 170~190° C. | Δ | X |
| Fatty acid ester | 1 | 150° C. | X | X |
| | | 170~190° C. | X | X |
| Polyether | 1 | 150° C. | X | X |
| | | 170~190° C. | X | X |
| Polyoxyethylene(POE) alkyl alkylate | 1 | 150° C. | X | X |
| | | 170~190° C. | X | X |

Meantime, the foregoing detailed explanation should not be interpreted as being limiting in all aspects, but be considered as being exemplary. The scope of the present invention should be determined by a rational interpretation of the attached claims, and all changes should be understood as covering all equivalents or substitutions within the scope of the present invention.

What is claimed is:

1. A manufacturing method of a thermoplastic elastomer yarn with improved unwinding, weaving and yarn shrinking property, the method comprising:

spinning a mono filament yarn of a thermoplastic elastomer material;

drawing (elongating) the spun mono filament yarn after cooling;

hot-air drying the drawn yarn under a heat-processing temperature of 170° C.~190° C.; and oil-treating the air-dried yarn;

wherein the oil used in the oil treating step is a mineral oil.

2. The method of claim 1, wherein the thermoplastic elastomer is TPE copolymer or polyester-ether copolymer.

3. The method of claim 1, wherein the oil contains OPU (Oil Pick Up) at 0.2%~3%.

4. The method of claim 1, wherein the drawing step comprises:

cooling the spun yarn under water with a temperature of 10° C.~50° C.;

implementing an initial elongation of the cooled yarn under water with a temperature of 70° C.~100° C.; and implementing a secondary elongation after the initial elongation using a hot air with a temperature of 120° C.~200° C.

* * * * *